US011274003B2

(12) United States Patent
Hashimoto et al.

(10) Patent No.: US 11,274,003 B2
(45) Date of Patent: Mar. 15, 2022

(54) IMAGE FORMING APPARATUS THAT CONTROLS THE SPEED DIFFERENCE BETWEEN A TRANSFER BELT AND A CONVEYING UNIT OR A FIXING UNIT

(71) Applicant: BROTHER KOGYO KABUSHIKI KAISHA, Nagoya (JP)

(72) Inventors: Junichi Hashimoto, Toyohashi (JP); Masafumi Inoue, Tajimi (JP); Shuji Ota, Nagoya (JP); Shuhei Hatano, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 207 days.

(21) Appl. No.: 16/582,189

(22) Filed: Sep. 25, 2019

(65) Prior Publication Data

US 2020/0102170 A1 Apr. 2, 2020

(30) Foreign Application Priority Data

Sep. 28, 2018 (JP) ..... JP2018-183828

(51) Int. Cl.
*B65H 5/02* (2006.01)
*G03G 15/00* (2006.01)
*G03G 15/22* (2006.01)

(52) U.S. Cl.
CPC ..... *B65H 5/021* (2013.01); *G03G 15/22* (2013.01); *G03G 15/5008* (2013.01);
(Continued)

(58) Field of Classification Search
CPC ..... B65H 5/021; B65H 2301/4473; B65H 2513/10; B65H 2535/20; G03G 15/22;
(Continued)

(56) References Cited

U.S. PATENT DOCUMENTS 6,198,897 B1 * 3/2001 Ream ..... G03G 15/1615 399/121
6,661,981 B2 * 12/2003 Boothe ..... G03G 15/1605 399/301

(Continued)

FOREIGN PATENT DOCUMENTS

JP 11-344875 A 12/1999
JP 2004-151383 A 5/2004
JP 2007-010839 A 1/2007

OTHER PUBLICATIONS

Office Action issued in related Chinese Patent Application 20191092239.2, dated Dec. 31, 2021.

*Primary Examiner* — Justin N Olamit
(74) *Attorney, Agent, or Firm* — Merchant & Gould P.C.

(57) ABSTRACT

An image forming apparatus includes: a belt unit including a transfer belt and a first memory that stores a first sheet conveying speed of the transfer belt; a second memory storing a first reference value and a second sheet conveying speed of the fixing unit a controller configured to: control at least one of the belt motor and the fixing motor to bring the speed difference between the sheet conveying speed of the transfer belt and the sheet conveying speed of the fixing unit closer to the first reference value by setting a rotational speed of the fixing motor based on the first reference value and a first speed difference between the first sheet conveying speed read from the first memory and the second sheet conveying speed read from the second memory.

26 Claims, 6 Drawing Sheets

(52) U.S. Cl.
CPC ..... *G03G 15/657* (2013.01); *G03G 15/6555* (2013.01); *B65H 2301/4473* (2013.01); *B65H 2513/10* (2013.01); *B65H 2555/20* (2013.01); *G03G 2215/00139* (2013.01); *G03G 2215/00413* (2013.01); *G03G 2215/00603* (2013.01)

(58) Field of Classification Search
CPC ..... G03G 15/5008; G03G 15/6555; G03G 15/657; G03G 2215/00139; G03G 2215/00413; G03G 2215/00603
See application file for complete search history.

(56) References Cited

U.S. PATENT DOCUMENTS

| | | | | |
|---|---|---|---|---|
| 6,897,982 | B1 * | 5/2005 | Ashida | G06K 15/1209 358/3.09 |
| 7,409,178 | B2 * | 8/2008 | Yokono | G03G 15/0152 399/121 |
| 7,574,150 | B2 * | 8/2009 | Eom | G03G 15/5004 347/129 |
| 9,383,712 | B2 * | 7/2016 | Noguchi | G03G 21/1821 |
| 9,625,860 | B2 * | 4/2017 | Kurita | G03G 15/2028 |
| 2007/0177894 | A1 | 8/2007 | Nakano et al. | |
| 2015/0139675 | A1 * | 5/2015 | Maruyoshi | G03G 15/2028 399/68 |

* cited by examiner

IMAGE FORMING APPARATUS THAT CONTROLS THE SPEED DIFFERENCE BETWEEN A TRANSFER BELT AND A CONVEYING UNIT OR A FIXING UNIT

CROSS-REFERENCE TO RELATED APPLICATION

This application claims priorities from Japanese Patent Application No. 2018-183828 filed on Sep. 28, 2018, the entire subject matters of which is incorporated herein by reference.

TECHNICAL FIELD

The present invention relates to an image forming apparatus including an apparatus main body and a belt unit attachable to and detachable from the apparatus main body.

BACKGROUND

In the related art, an image forming apparatus including an apparatus main body, a photosensitive drum, a belt unit attachable to and detachable from the apparatus main body, a fixing unit positioned behind the belt unit, and a conveyance roller conveying a sheet such as paper toward the belt unit is known. In this type of image forming apparatus, the belt unit includes a conveyance belt, and is configured to convey the sheet between the conveyance belt and the photosensitive drum.

When a speed difference between a sheet conveying speed of the conveyance belt and the sheet conveying speed of the fixing unit becomes large, the sheet may be excessively bent between the conveyance belt and the fixing unit. When the speed difference between the sheet conveying speed of the conveyance roller and the sheet conveying speed of the conveyance belt becomes large, the sheet may be excessively bent between the conveyance roller and the conveyance belt.

On the other hand, when the speed difference between the sheet conveying speed of the conveyance belt and the sheet conveying speed of the fixing unit becomes small, the sheet may slip in the belt unit or the fixing unit. When the speed difference between the sheet conveying speed of the conveyance roller and the sheet conveying speed of the conveyance belt becomes small, the sheet may slip on the conveyance roller or the belt unit.

When the sheet is excessively bent or the sheet is slipped, for example, a printing surface may be rubbed and an image quality may be deteriorated.

SUMMARY

The present disclosure has been made in view of the above circumstances, and one of objects of the present disclosure is an image forming apparatus that is configured to suppress excessive bending of the sheet and slippage of the sheet.

According to an illustrative embodiment of the present disclosure, there is provided an image forming apparatus including: an apparatus main body; a photosensitive drum; a belt unit that is detachable attachable to the apparatus main body, the belt unit including a transfer belt and a first memory, the transfer belt being configured to convey the sheet and to transfer a toner image on the photosensitive drum onto the sheet, the first memory storing a first sheet conveying speed which is a sheet conveying speed of the transfer belt; a fixing unit configured to fix the toner image on the sheet conveyed by the transfer belt to the sheet in a state where the belt unit is attached to the apparatus main body; a belt motor configured to drive the transfer belt; a fixing motor configured to drive the fixing unit; a second memory storing a second sheet conveying speed and a first reference value, wherein the second sheet conveying speed is a sheet conveying speed of the fixing unit, and wherein the first reference value is a reference value of a speed difference between the sheet conveying speed of the transfer belt and the sheet conveying speed of the fixing unit; and a controller. The controller is configured to: read the first sheet conveying speed from the first memory; read the second sheet conveying speed from the second memory; and control at least one of the belt motor and the fixing motor to bring the speed difference between the sheet conveying speed of the transfer belt and the sheet conveying speed of the fixing unit closer to the first reference value by setting at least one of a rotational speed of the belt motor and a rotational speed of the fixing motor based on the first reference value and a first speed difference which is a speed difference between the first sheet conveying speed read from the first memory and the second sheet conveying speed read from the second memory.

According to another illustrative embodiment of the present disclosure, there is provided an image forming apparatus including: an apparatus main body; a photosensitive drum; a belt unit that is detachably attachable to the apparatus main body, the belt unit including a transfer belt and a first memory, the transfer belt being configured to convey the sheet and to transfer a toner image on the photosensitive drum onto the sheet, the first memory storing a first sheet conveying speed which is a sheet conveying speed of the transfer belt; a conveyance roller configured to convey the sheet toward the transfer belt in a state where the belt unit is attached to the apparatus main body; a belt motor configured to drive the transfer belt; a conveyance motor configured to drive the conveyance roller; a second memory storing a third sheet conveying speed and a second reference value, wherein the third sheet conveying speed is a sheet conveying speed of the conveyance roller, and wherein the second reference value is a reference value of a speed difference between the sheet conveying speed of the transfer belt and the sheet conveying speed of the conveyance roller; and a controller. The controller is configured to: read the first sheet conveying speed from the first memory; read the third sheet conveying speed from the second memory; and control at least one of the belt motor and the fixing motor to bring the speed difference between the sheet conveying speed of the transfer belt and the sheet conveying speed of the conveyance roller closer to the second reference value by setting at least one of a rotational speed of the belt motor and a rotational speed of the conveyance motor based on the second reference value and a second speed difference which is a speed difference between the first sheet conveying speed read from the first memory and the third sheet conveying speed read from the second memory.

DETAILED DESCRIPTION

Figure 1:
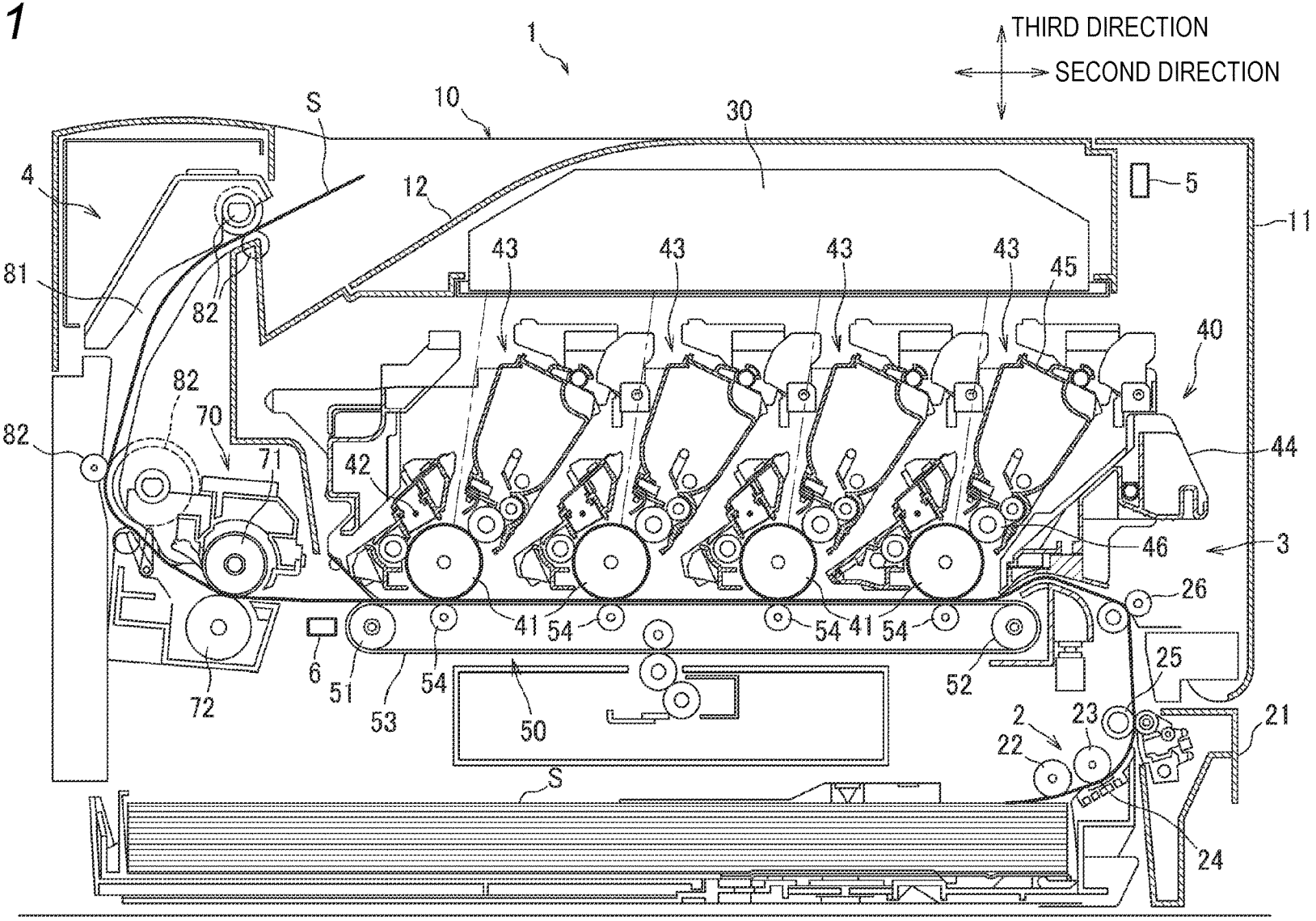
FIG. 1 is a cross-sectional view of an image forming apparatus according to an embodiment.

Next, an embodiment according to the present disclosure will be described in detail with reference to the accompanying drawings. In the following description, an axial direction of a photosensitive drum 41 is referred to as a first direction. A direction in which a plurality of photosensitive drums 41 is arranged is referred to as a second direction. The second direction intersects the first direction. Preferably, the second direction is orthogonal to the first direction. A direction in which a discharge tray 12, an image forming unit 3, and a sheet tray 21 are arranged is referred to as a third direction. The third direction intersects the first direction and the second direction. Preferably, the third direction is orthogonal to the first direction and the second direction.

As illustrated in FIG. 1, an image forming apparatus 1 includes an apparatus main body 10, a sheet supply unit 2, the image forming unit 3, a sheet discharge unit 4, a first sensor 5, and a second sensor 6.

The apparatus main body 10 includes a cover 11 at one end side in the second direction, the cover being movable between an opened state and a closed state. The cover 11 is opened when a process unit 40 and a belt unit 50 described later are attached and detached. The apparatus main body 10 includes a discharge tray 12.

The first sensor 5 is a sensor. The first sensor 5 is configured to detect the opened state and the closed state of the cover 11. The first sensor 5 is, for example, an interlock switch including a lever. The first sensor 5 detects that the cover 11 is closed when the cover 11 is closed and a lever is pressed by a part of the cover 11. The first sensor 5 detects that the cover 11 is opened when the cover 11 is opened and pressing of the lever is released.

The sheet supply unit 2 includes a sheet tray 21, a pickup roller 22, a separation roller 23, a separation pad 24, a paper dust removing roller 25, and a registration roller 26 as an example of a conveyance roller. The sheet tray 21 accommodates a sheet S such as paper.

The pickup roller 22 feeds a sheet S in the sheet tray 21 toward the separation roller 23. The separation roller 23 and the separation pad 24 separate the sheets S one by one and conveys the sheet S toward the image forming unit 3. The paper dust removing roller 25 conveys the sheet S toward the image forming unit 3. The registration roller 26 regulates a tip position of the sheet S, and then supplies the sheet S to the image forming unit 3.

The image forming unit 3 includes an exposure unit 30, a process unit 40, a belt unit 50, and a fixing unit 70.

The exposure unit 30 is positioned at one end side in the third direction in the apparatus main body 10. The exposure unit 30 emits a light beam (see one dot chain line) to expose the surface of the photosensitive drum 41.

The process unit 40 includes a plurality of photosensitive drums 41 arranged in the second direction, a plurality of chargers 42 and developing cartridges 43 corresponding to respective photosensitive drums 41, and a process frame 44 supporting the photosensitive drums 41 and the like. The process unit 40 can be attached to and detached from the apparatus main body 10 in a state where the cover 11 is at the opened state. The process unit 40 is positioned between the sheet tray 21 and the exposure unit 30 in a state of being attached to the apparatus main body 10.

The developing cartridges 43 are individually attachable to and detachable from the process frame 44. The developing cartridges 43 can be attached to and detached from the apparatus main body 10 together with the process unit 40 in a state of being attached to the process unit 40. Each developing cartridge 43 includes a developer casing 45 for storing developer and a developing roller 46.

The belt unit 50 includes a belt drive roller 51, a belt driven roller 52, a transfer belt 53, and a plurality of transfer rollers 54.

The belt drive roller 51 is a roller that drives the transfer belt 53. The belt driven roller 52 is rotated by being driven by the transfer belt 53. The belt driven roller 52 is positioned at a position apart from the belt driving roller 51 in the second direction. The belt drive roller 51 and the belt driven roller 52 are in contact with the inner circumferential surface of the transfer belt 53.

The transfer belt 53 is an endless belt. The transfer belt 53 transfers a toner image on the photosensitive drum 41 to the sheet S by applying a bias to the transfer rollers 54. Simultaneously, the transfer belt 53 conveys the sheet S. Specifically, the transfer rollers 54 are positioned inside the transfer belt 53. The transfer rollers 54 sandwich the transfer belt 53 with the photosensitive drums 41. Then, when the photosensitive drums 41, the transfer belt 53, and the transfer rollers 54 rotate, the transfer belt 53 conveys the sheet S toward the fixing unit 70 between the transfer belt 53 and the photosensitive drums 41.

The belt unit 50 is attachable to and detachable from the apparatus main body 10 in a state where the cover 11 is at the opened state and the process unit 40 is removed. The belt unit 50 is positioned between the sheet tray 21 and the exposure unit 30 in a state of being attached to the apparatus main body 10. Furthermore, the belt unit 50 is positioned between the sheet tray 21 and the process unit 40 by attaching the process unit 40 on the apparatus main body 10.

The second sensor 6 is a sensor. The second sensor 6 is configured to detect whether or not the belt unit 50 is attached to the apparatus main body 10. The second sensor 6 is, for example, a sensor that is configured to detect the current flowing through the transfer belt 53. When the current flowing through the transfer belt 53 is detected, the second sensor 6 detects that the belt unit 50 is attached to the apparatus main body 10. When the current flowing through the transfer belt 53 cannot be detected, the second sensor 6 detects that the belt unit 50 is not attached to the apparatus main body 10.

The fixing unit 70 is positioned in the apparatus main body 10. The fixing unit 70 fixes the toner image on the sheet S conveyed by the transfer belt 53 to the sheet S in a state where the belt unit 50 is attached to the apparatus main body 10. The fixing unit 70 includes a fixing roller 71 that is configured to heat the sheet S, and a pressure roller 72 that presses the fixing roller 71. The fixing roller 71 is a cylindrical member made of metal. The pressure roller 72 is a member having an elastic layer around a metallic core bar.

The image forming unit 3 charges the surface of the photosensitive drums 41 with the chargers 42. Next, the image forming unit 3 exposes the surface of the photosensitive drums 41 with the exposure unit 30. With this configuration, the image forming unit 3 forms an electrostatic latent image on the photosensitive drums 41. Next, the image forming unit 3 supplies developer from the developing roller 46 to the photosensitive drums 41. With this configuration, the image forming unit 3 turns the electrostatic latent image to be visible and forms a developer image on the photosensitive drums 41.

Next, the image forming unit 3 conveys the sheet S supplied from the sheet supply unit 2 between the photosensitive drums 41 and the transfer belt 53. With this configuration, the image forming unit 3 transfers the developer image on the photosensitive drums 41 to the sheet S. Then, in the image forming unit 3 conveys the sheet S on which the developer image has been transferred between the fixing roller 71 and the pressure roller 72. With this configuration, the image forming unit 3 thermally fixes the developer image on the sheet S to form an image on the sheet S.

The sheet discharge unit 4 has a discharge path 81 and a plurality of discharge rollers 82. The discharge roller 82 discharges the sheet S on which the image is formed onto the discharge tray 12 of the apparatus main body 10 through the discharge path 81.

Figure 2:
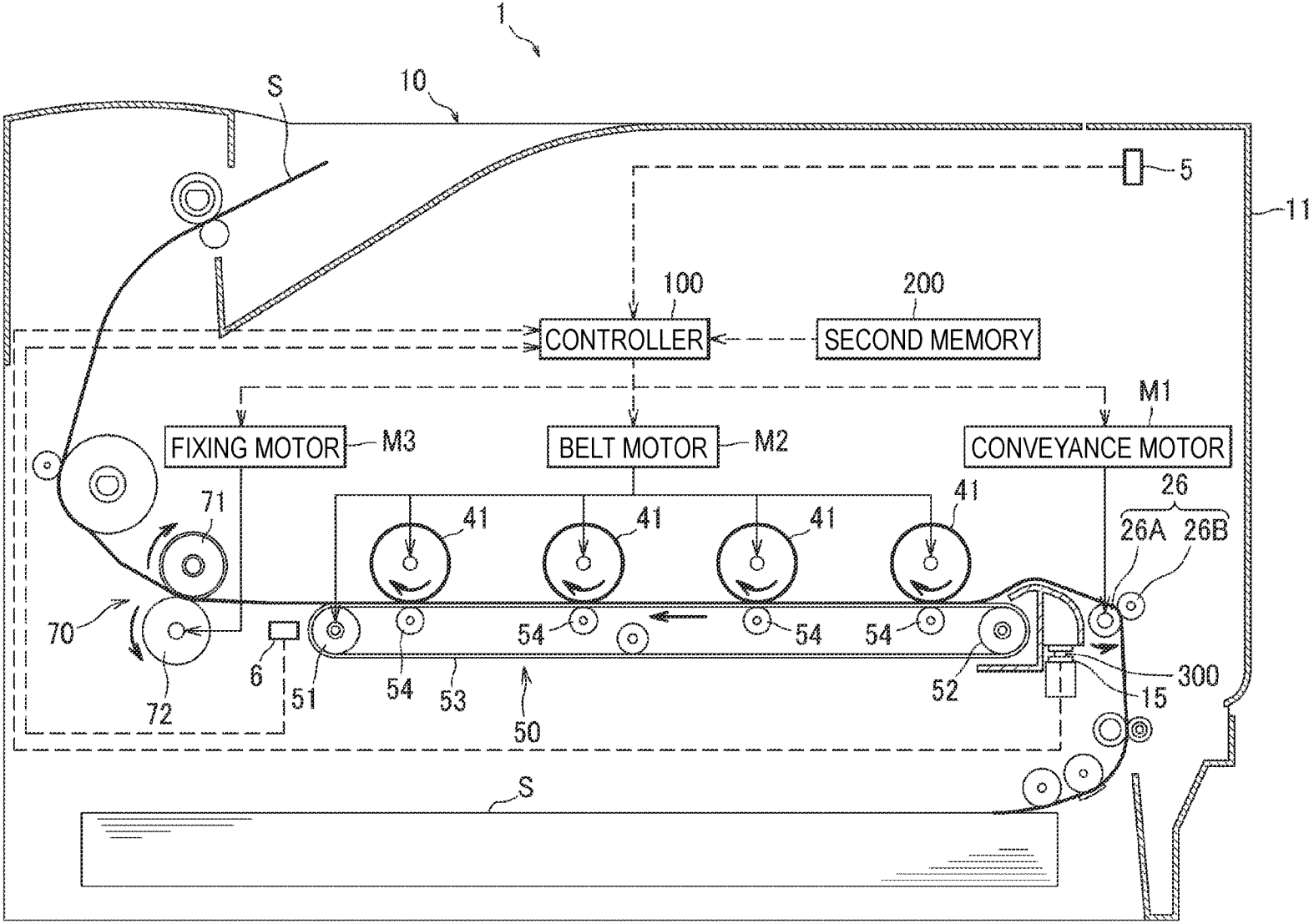
FIG. 2 is a diagram illustrating a configuration relating to control of the image forming apparatus.

As illustrated in FIG. 2, the image forming apparatus 1 includes a controller 100, a second memory 200, a conveyance motor M1, a belt motor M2, and a fixing motor M3. The belt unit 50 also includes a first memory 300.

The conveyance motor M1 drives the registration roller 26. Specifically, the registration roller 26 includes a conveyance driving roller 26A and a conveyance driven roller 26B. Then, the conveyance driving roller 26A is rotated by allowing a driving force to be applied to the conveyance driving roller 26A from the conveyance motor M1 through a plurality of gears (not illustrated) and the like. The conveyance driven roller 26B is rotated by being driven by the conveyance driving roller 26A. When the registration roller 26 is driven in a state where the process unit 40 and the belt unit 50 are attached to the apparatus main body 10, the sheet S is conveyed toward the space between the photosensitive drums 41 and the transfer belt 53.

The belt motor M2 drives the transfer belt 53. Specifically, the belt motor M2 drives the belt drive roller 51 through a plurality of gears (not illustrated) and the like, and accordingly, the transfer belt 53 is driven. The belt motor M2 drives the photosensitive drums 41 through a plurality of gears (not illustrated) and the like. When the photosensitive drum 41 and the transfer belt 53 are driven, the sheet S is conveyed toward the fixing unit 70.

The fixing motor M3 drives the fixing unit 70. Specifically, the pressure roller 72 rotates by allowing a driving force to be applied to the pressure roller 72 from the fixing motor M3 through a plurality of gears (not illustrated) and the like. The fixing roller 71 is rotated by being driven by the pressure roller 72. When the fixing roller 71 and the pressure roller 72 rotate, the sheet S is carried out to the discharge path 81 (see FIG. 1).

Figure 3:
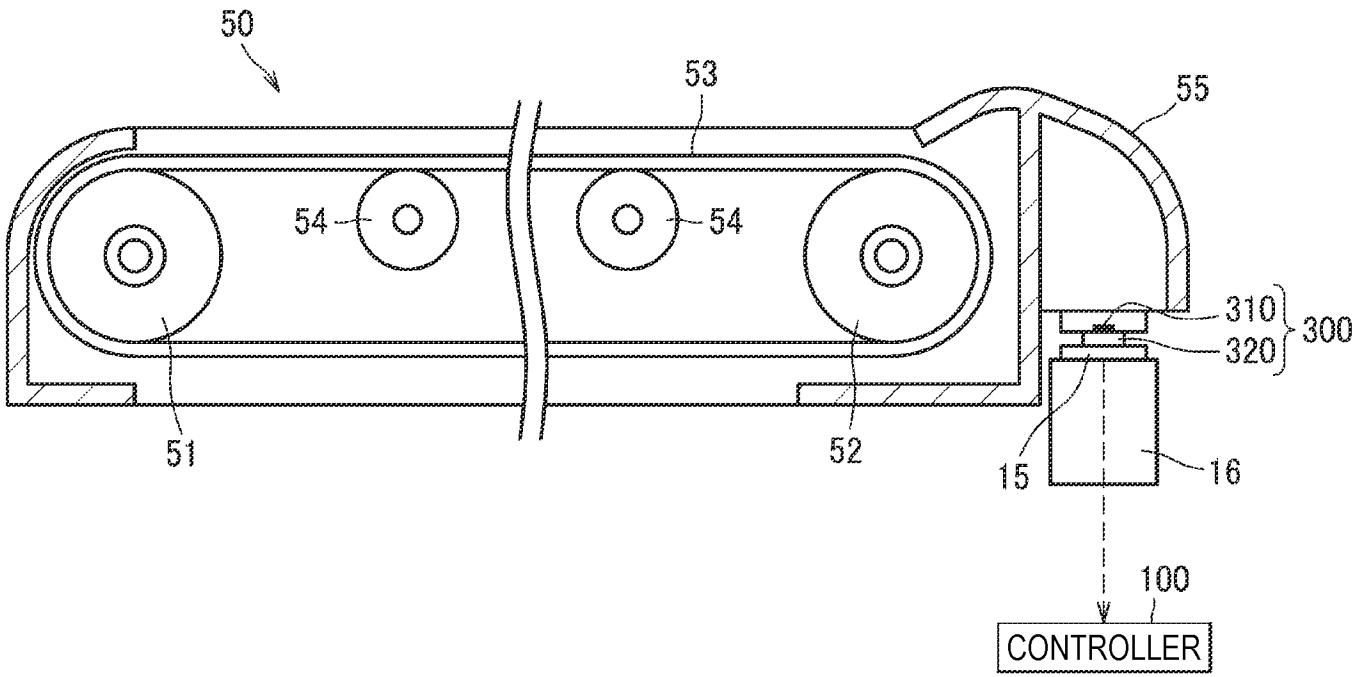
FIG. 3 is an enlarged view of a belt unit and an electrical contact of the image forming apparatus.

As illustrated in FIG. 3, a first memory 300 is supported by a belt frame 55 of the belt unit 50. The belt frame 55 is a member that rotatably supports the belt drive roller 51, the belt driven roller 52, and the transfer roller 54. The first memory 300 includes a storage element 310 and an electrical contact surface 320. The electrical contact surface 320 is electrically connected to the storage element 310.

The image forming apparatus 1 includes an electrical contact 15. The electrical contacts 15 can be in electrical contact with the electrical contact surface 320 of the belt unit 50 in a state where the belt unit 50 is attached to the apparatus main body 10. The electrical contact 15 is held by a contact holder 16 in the apparatus main body 10. The storage element 310 of the first memory 300 can be electrically connected to the controller 100 through the electrical contact surface 320 and the electrical contact 15 in a state where the belt unit 50 is attached to the apparatus main body 10.

The first memory 300 (storage element 310) stores information on the belt unit 50. Storing of information on the belt unit 50 in the first memory 300 is performed in a manufacturing process of the belt unit 50 in a manufacturing plant. The first memory 300 stores a first sheet conveying speed VBs as one of information on the belt unit 50.

The first sheet conveying speed VBs is a sheet conveying speed of the transfer belt 53 based on a value measured in advance. The first sheet conveying speed VBs stored in the first memory 300 is, for example, an actual measurement value of the sheet conveying speed of the transfer belt 53 measured in advance. The first sheet conveying speed VBs is a moving speed of the transfer belt 53 obtained by applying a driving force to the belt drive roller 51 to rotate the transfer belt 53 after the belt unit 50 is assembled and measuring at that time.

The first sheet conveying speed VBs stored in the first memory 300 may be a calculation value calculated based on a thickness of the transfer belt 53 measured in advance and a value of an outer diameter of the belt drive roller 51. The first sheet conveying speed VBs [mm/s] can be calculated from measured values of a thickness T53 [mm] of the transfer belt 53 and an outer diameter D51 [mm] of the belt drive roller 51, and a rotational speed N51 [rpm] of the belt drive roller 51 according to the following equation.

$$VBs=(D51+T53\times 2)\times\pi\times N51/60$$

The first sheet conveying speed VBs is a value unique to the belt unit 50. For that reason, the first sheet conveying speed VBs usually takes a different value by replacing the belt unit 50 with a new one.

Returning to FIG. 2, the second memory 200 is electrically connected to the controller 100. Although the second memory 200 and the controller 100 are illustrated separately in the attached drawings, the controller 100 may include the second memory 200.

The second memory 200 stores information on the image forming apparatus 1. Storing of information on the image forming apparatus 1 in the second memory 200 is performed in the manufacturing process of the image forming apparatus 1 in the manufacturing plant.

The second memory 200 stores a second sheet conveying speed VFs as information on the image forming apparatus 1. The second sheet conveying speed VFs is a sheet conveying speed of the fixing unit 70 based on a value measured in advance.

The second sheet conveying speed VFs stored in the second memory 200 is, for example, an actual measurement value of the sheet conveying speed of the fixing unit 70 measured in advance. The second sheet conveying speed VFs is a circumferential speed of the fixing roller 71 obtained by applying a driving force to the pressure roller 72 to rotate the fixing roller 71 after the fixing unit 70 or the image forming apparatus 1 is assembled and measuring at that time.

The second sheet conveying speed VFs stored in the second memory 200 may be a calculation value calculated based on the value of the outer diameter of the fixing roller 71 measured in advance. The second sheet conveying speed VFs [mm/s] can be calculated from the measured value of the outer diameter D71 [mm] of the fixing roller 71 and the rotational speed N71 [rpm] of the fixing roller 71 according to the following equation.

$$VFs=D71\times\pi\times N71/60$$

Here, the first sheet conveying speed VBs of the transfer belt 53 stored in the first memory 300 is set to a speed faster than the second sheet conveying speed VFs of the fixing unit 70 stored in the second memory 200.

The second memory 200 stores a third sheet conveying speed VCs as information on the image forming apparatus 1. The third sheet conveying speed VCs is a sheet conveying speed of the registration roller 26 based on a value measured in advance.

The third sheet conveying speed VCs stored in the second memory 200 is, for example, an actual measurement value of the sheet conveying speed of the registration roller 26 measured in advance. The third sheet conveying speed VCs is a circumferential speed of the conveyance driving roller 26A obtained by applying a driving force to the conveyance driving roller 26A to rotate the conveyance driving roller 26A after the image forming apparatus 1 is assembled and measuring at that time.

The third sheet conveying speed VCs stored in the second memory 200 may be a calculation value calculated based on the value of the outer diameter of the conveyance driving roller 26A measured in advance. The third sheet conveying speed VCs [mm/s] can be calculated from the measured value of an outer diameter D26 [mm] of the conveyance driving roller 26A and a rotational speed N26 [rpm] of the conveyance driving roller 26A according to the following equation.

$$VCs=D26\times\pi\times N26/60$$

Here, the first sheet conveying speed VBs stored in the first memory 300 is set to a speed slower than the third sheet conveying speed VCs of the registration roller 26 stored in the second memory 200.

The second memory 200 stores a reference sheet conveying speed VBr. The reference sheet conveying speed VBr is, for example, a reference value of the sheet conveying speed of the transfer belt 53, which is set in advance based on results of experiments and simulations.

The second memory 200 stores a first reference value VA1. The first reference value VA1 is a reference value of the speed difference between the sheet conveying speed of the transfer belt 53 and the sheet conveying speed of the fixing unit 70. The first reference value VA1 is a speed difference between the reference sheet conveying speed VBr and a reference value VFr of the sheet conveying speed of the fixing unit 70 set in advance. The controller 100 controls a speed difference between an actual sheet conveying speed of the transfer belt 53 and an actual sheet conveying speed of the fixing unit 70 to approach the first reference value VA1.

Here, the "speed difference" may be, for example, a value obtained by subtracting the value of the sheet conveying speed of the transfer belt 53 from the value of the sheet conveying speed of the fixing unit 70, but in this embodiment, the speed difference is a speed ratio. The first reference value VA1 is expressed by the following equation.

$$VA1=VFr/VBr$$

The second memory 200 also stores a second reference value VA2. The second reference value VA2 is a reference value of the speed difference between the sheet conveying speed of the transfer belt 53 and the sheet conveying speed of the registration roller 26. The second reference value VA2 is a speed difference between the reference sheet conveying speed VBr and a reference value VCr of the sheet conveying speed of the registration roller 26 set in advance. The controller 100 controls a speed difference between the actual sheet conveying speed of the transfer belt 53 and an actual sheet conveying speed of the registration roller 26 to approach the second reference value VA2. The second reference value VA2 is expressed by the following equation.

$$VA2=VCr/VBr$$

The main memory 200 can rewrite stored information. For example, since the second sheet conveying speed VFs of the fixing unit 70 is a value unique to the fixing unit 70, when the fixing unit 70 is replaced by a serviceman, the second sheet conveying speed VFs is rewritten by the serviceman to the value unique to the fixing unit 70 after replacement.

For example, since the third sheet conveying speed VCs of the registration roller 26 is the value unique to the registration roller 26, when the registration roller 26 is replaced by the serviceman, the third sheet conveying speed VCs is rewritten to the value unique to the registration roller 26 after replacement by the serviceman.

Figure 4:
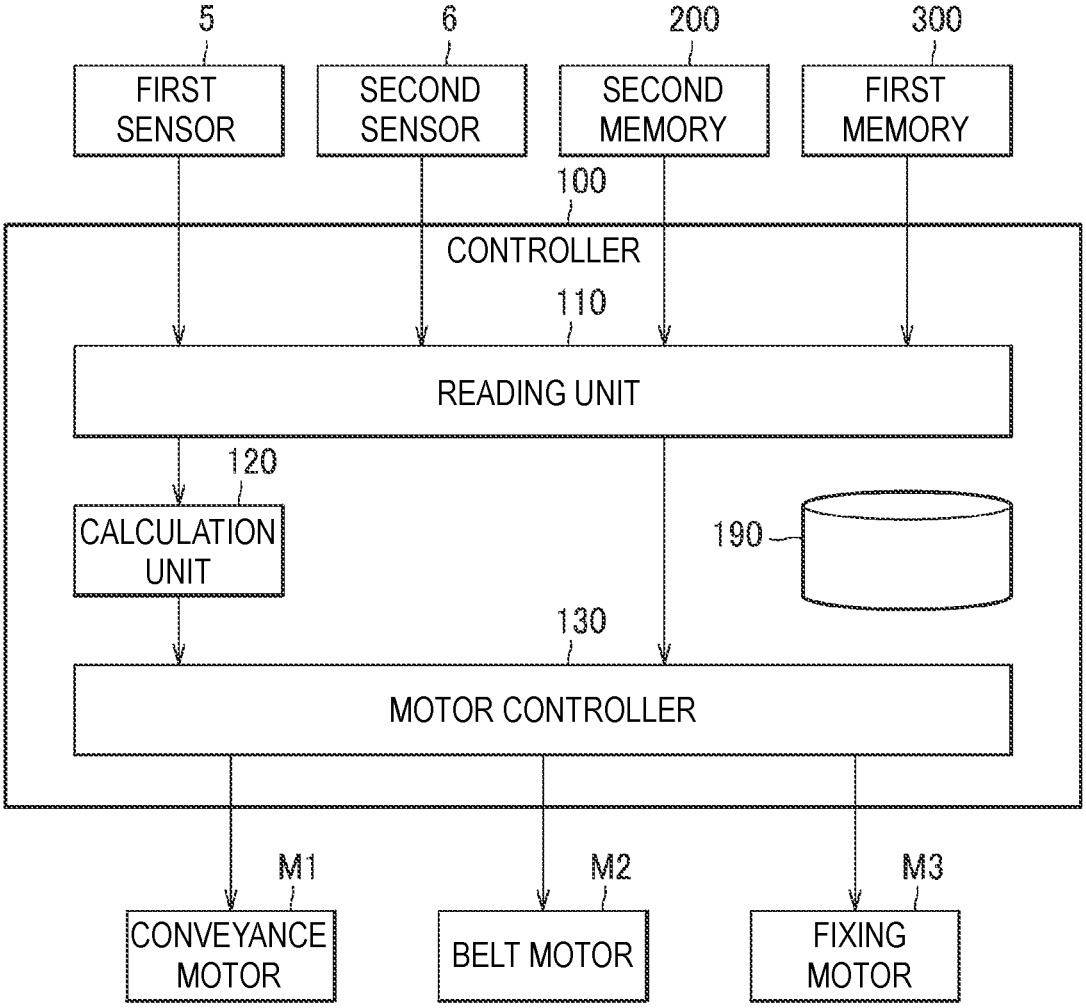
FIG. 4 is a block diagram of a controller.

As illustrated in FIG. 4, the controller 100 controls, for example, the motors M1 to M3 according to a program or the like which is set in advance. The controller 100 is electrically connected to the first sensor 5 and the second sensor 6. The controller 100 includes a CPU, a RAM, a ROM, an input and output circuit, and the like (not illustrated). The controller 100 includes a reading unit 110, a calculation unit 120, a motor controller 130, and a storage unit 190.

The reading unit 110 is configured to execute a reading process. When the first sensor 5 detects that the cover 11 is closed and the second sensor 6 detects that the belt unit 50 is attached to the apparatus main body 10, the reading unit 110 starts the reading process.

The reading unit 110 reads the first sheet conveying speed VBs from the first memory 300 and reads the second sheet conveying speed VFs and the third sheet conveying speed VCs from the second memory 200, in the reading process. The reading unit 110 also reads the reference sheet conveying speed VBr, the first reference value VA1, and the second reference value VA2 from the second memory 200.

Even when the first sheet conveying speed VBs cannot be read from the first memory 300, the reading unit 110 reads the second sheet conveying speed VFs, the third sheet conveying speed VCs, the reference sheet conveying speed VBr, and the first reference value VA1, and the second reference value VA2 from the second memory 200. The case where the information cannot be read from the first memory 300 although the belt unit 50 is attached to the apparatus main body 10 is, for example, a case where foreign matters adheres to the electrical contact surface 320 of the first memory 300 or the electrical contact 15 of the image forming apparatus 1 to cause contact failure.

The reading unit 110 outputs read information to the calculation unit 120 and the motor controller 130.

The calculation unit 120 is configured to execute a calculation process. The calculation unit 120 calculates a first speed difference VD1 in the calculation process. The first speed difference VD1 is a speed difference between the first sheet conveying speed VBs of the transfer belt 53 read in the reading process and the second sheet conveying speed VFs of the fixing unit 70 read in the reading process. The calculation unit 120 calculates the first speed difference VD1 according to the following equation.

$$VD1=VFs/VBs$$

The calculation unit 120 calculates a second speed difference VD2. The second speed difference VD2 is a speed difference between the first sheet conveying speed VBs and the third sheet conveying speed VCs of the registration roller 26 read in the reading process. The calculation unit 120 calculates the second speed difference VD2 according to the following equation.

$$VD2=VCs/VBs$$

The calculation unit 120 also calculates a third speed difference VD3. The third speed difference VD3 is a speed difference between the reference sheet conveying speed VBr of the transfer belt 53 read in the reading process and the second sheet conveying speed VFs. The calculation unit 120 calculates the third speed difference VD3 according to the following equation.

$$VD3=VFs/VBr$$

The calculation unit 120 calculates a fourth speed difference VD4. The fourth speed difference VD4 is a speed difference between the reference sheet conveying speed VBr and the third sheet conveying speed VCs. The calculation unit 120 calculates the fourth speed difference VD4 according to the following equation.

$$VD4=VCs/VBr$$

The calculation unit 120 calculates a fifth speed difference VBD. The fifth speed difference VBD is a speed difference between the first sheet conveying speed VBs and the reference sheet conveying speed VBr. The calculation unit 120 calculates the fifth speed difference VBD according to the following equation.

$$VBD=VBs/VBr$$

The calculation unit 120 outputs information of each calculated speed difference to the motor controller 130. When the first sheet conveying speed VBs cannot be read from the first memory 300 in the reading process, the calculation unit 120 outputs information on the third speed difference VD3 and fourth speed difference VD4 to the motor controller 130.

The motor controller 130 is configured to execute a motor control process. The motor controller 130 sets a rotational speed N3 of the fixing motor M3 from the first speed difference VD1 and the first reference value VA1 in the motor control process. The motor controller 130 also sets a rotational speed N1 of the conveyance motor M1 from the second speed difference VD2 and the second reference value VA2.

Then, in response to an instruction to drive the motors M1 to M3 being received, the motor controller 130 drives the conveyance motor M1 at the set rotational speed N1, drives the belt motor M2 at the rotational speed N2, and drives the fixing motor M3 at the set rotational speed N3. In this embodiment, the rotational speed N2 of the belt motor M2 is a default value set in advance, and is not changed by the first speed difference VD1 and the second speed difference VD2.

With this configuration, the motor controller 130 controls the rotational speed of the fixing motor M3 so that the speed difference between the actual sheet conveying speed of the transfer belt 53 and the actual sheet conveying speed of the fixing unit 70 when the image forming apparatus 1 is operated approaches the first reference value VA1. The motor controller 130 controls the rotational speed of the conveyance motor M1 so that the speed difference between the actual sheet conveying speed of the transfer belt 53 and the actual sheet conveying speed of the registration roller 26 when the image forming apparatus 1 is operated approaches the second reference value VA2.

When the first speed difference VD1 is larger than the first reference value VA1, the motor controller 130 reduces the rotational speed N3 of the fixing motor M3. When the first speed difference VD1 is smaller than the first reference value VA1, the motor controller 130 increases the rotational speed N3 of the fixing motor M3. As an example, the motor controller 130 can calculate the rotational speed N3 of the fixing motor M3 according to the following equation. Here, N3*d* is a default value of the rotational speed of the fixing motor M3 set in advance.

$$N3=N3d\times VA1/VD1$$

When the second speed difference VD2 is larger than the second reference value VA2, the motor controller 130 reduces the rotational speed N1 of the conveyance motor M1. When the second speed difference VD2 is smaller than the second reference value VA2, the motor controller 130 increases the rotational speed N1 of the conveyance motor M1. As an example, the motor controller 130 can calculate the rotational speed N1 of the conveyance motor M1 according to the following equation. Here, N1*d* is a default value of the rotational speed of the conveyance motor M1 set in advance.

$$N1=N1d\times VA2/VD2$$

When the rotational speed N3 (the current value $N3_n$) of the fixing motor M3 is newly set, the motor controller 130 replaces the previous value ($N3_{n-1}$) of the rotational speed N3 of the fixing motor M3 with the current value and stores the current value in the storage unit 190. Then, the rotational speed $N3_n$ is used to drive the fixing motor M3 until the rotational speed N3 (next value $N3_{n+1}$) of the fixing motor M3 is newly set.

Similarly, when the rotational speed N1 (current value $N1_n$) of the conveyance motor M1 is newly set, the motor controller 130 replaces the previous value ($N1_{n-1}$) of the rotational speed N1 of the conveyance motor M1 with the current value and stores the current value in the storage unit 190. Then, the rotational speed $N1_n$ is used to drive the conveyance motor M1 until the rotational speed N1 (next value $N1_{n-1}$) of the conveyance motor M1 is newly set.

In this embodiment, when the fifth speed difference VBD is outside a range of a determination threshold set in advance, specifically, when the fifth speed difference VBD is less than the minimum value VBD1 of a determination threshold and when the fifth speed difference VBD is larger than the maximum value VBD2 of the determination threshold, it is considered that the value of the first sheet conveying speed VBs read from the first memory 300 in the reading process is an abnormal value.

For that reason, when the fifth speed difference VBD is out of the range of the determination threshold, the motor controller 130 does not use the first speed difference VD1 calculated by the calculation unit 120, and sets the third speed difference VD3 as the first speed difference VD1. When the fifth speed difference VBD is out of the range of the determination threshold, the motor controller 130 does not use the second speed difference VD2 calculated by the calculation unit 120, and sets the fourth speed difference VD4 as the second speed difference VD2.

Even when the first sheet conveying speed VBs cannot be read from the first memory 300 in the reading process, the motor controller 130 sets the third speed difference VD3 as the first speed difference VD1. Similarly, when the first sheet conveying speed VBs cannot be read from the first memory 300 in the reading process, the motor controller 130 sets the fourth speed difference VD4 as the second speed difference VD2.

Next, a process of setting the rotational speed N3 of the fixing motor M3 by the controller 100 will be described. When the cover 11 is closed from an opened state, the controller 100 starts the process of setting the rotational speed N3 of the fixing motor M3.

Figure 5:
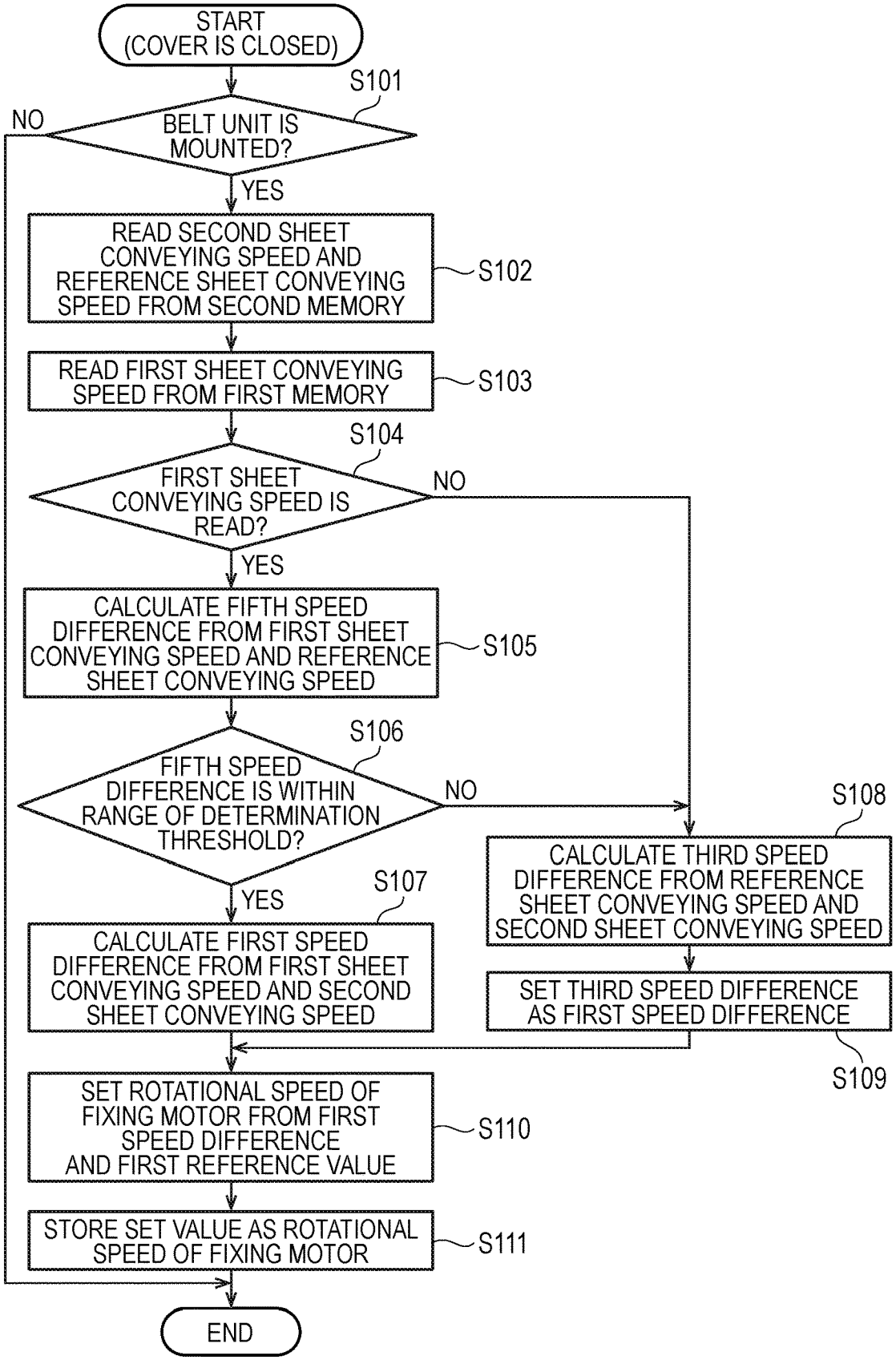
FIG. 5 is a flowchart illustrating a process of setting a rotational speed of a fixing motor.

As illustrated in FIG. 5, when the cover 11 is closed (START), the controller 100 determines whether or not the belt unit 50 is attached to the apparatus main body 10 (S101). When it is determined that the belt unit 50 is not attached to the apparatus main body 10 (No in S101), the controller 100 ends the process of setting the rotational speed.

On the other hand, when it is determined that the belt unit 50 is attached to the apparatus main body 10 (Yes in S101), the controller 100 reads the second sheet conveying speed VFs of the fixing unit 70 and the reference sheet conveying speed VBr of the transfer belt 53 from the second memory 200 (S102) (reading process). The controller 100 reads the first sheet conveying speed VBs of the transfer belt 53 from the first memory 300 (S103) (reading process).

Then, when it is determined that the first sheet conveying speed VBs is read from the first memory 300 (Yes in S104), the controller 100 calculates the fifth speed difference VBD from the first sheet conveying speed VBs and the reference sheet conveying speed VBr (S105). Then, the controller 100 determines whether or not the fifth speed difference VBD is within the range of the determination threshold (S106).

When it is determined that the fifth speed difference VBD is within the range of the determination threshold (Yes in S106), the controller 100 calculates the first speed difference VD1 from the first sheet conveying speed VBs and the second sheet conveying speed VFs (S107), and proceeds to step S110.

When it is determined that the first sheet conveying speed VBs cannot be read from the first memory 300 in step S104 (No in S104) and when it is determined that the fifth speed difference VBD is not within the determination threshold range in step 5106 (No in S106), the controller 100 calculates the third speed difference VD3 from the reference sheet conveying speed VBr and the second sheet conveying speed VFs (S108). Then, the controller 100 sets the third speed difference VD3 as the first speed difference VD1 (S109).

In step S110, the controller 100 sets the rotational speed N3 of the fixing motor M3 from the first speed difference VD1 and the first reference value VA1 (S110) (motor control process). Then, the controller 100 stores the set rotational speed N3 as the rotational speed of the fixing motor M3 (S111), and ends the process of setting the rotational speed of the fixing motor M3.

Next, a process of setting the rotational speed N1 of the conveyance motor M1 by the controller 100 will be described. The same processing as the processing for setting the rotational speed N3 of the fixing motor M3 will be assigned the same reference numerals and description thereof will be omitted as appropriate.

Figure 6:
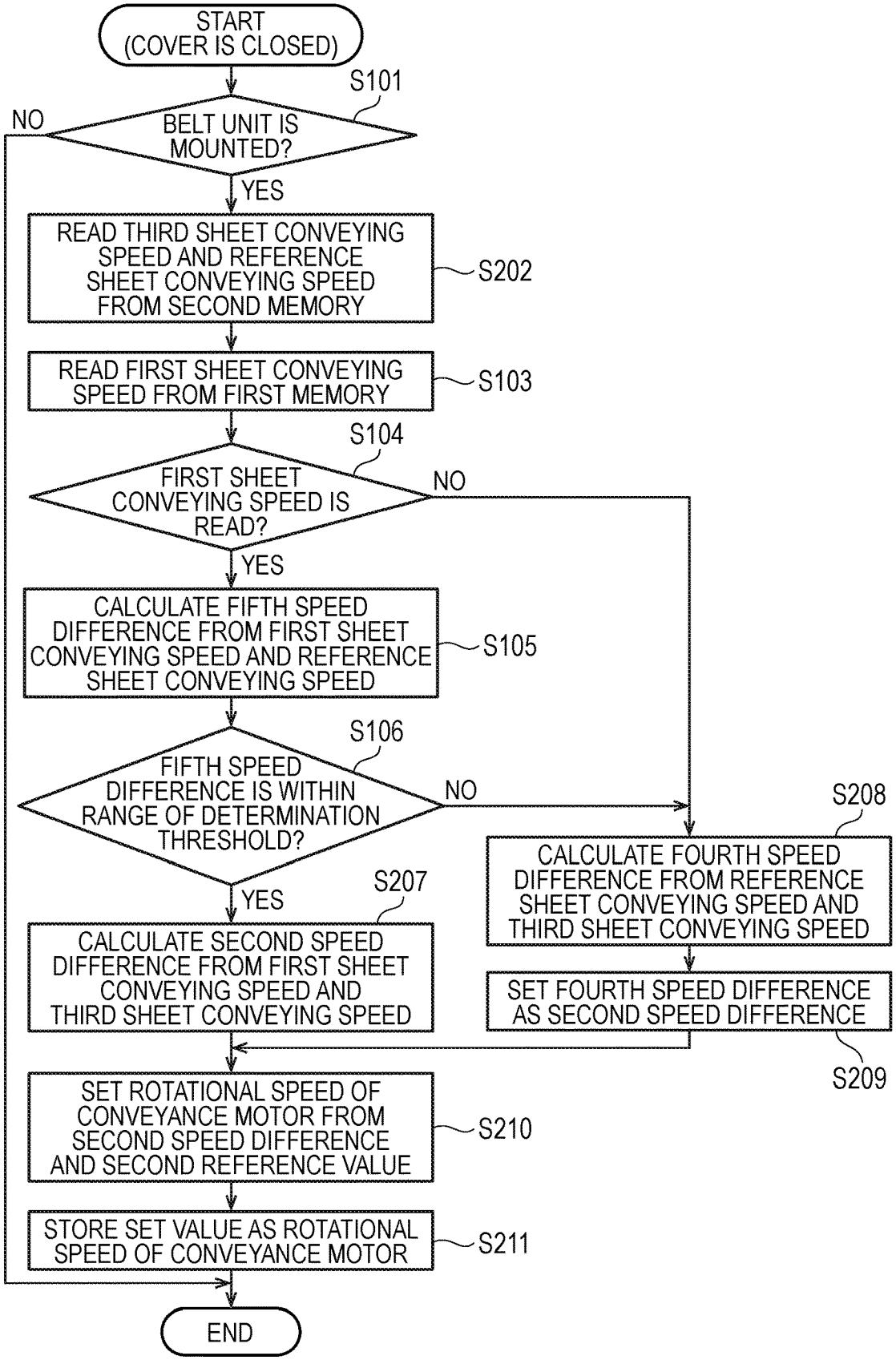
FIG. 6 is a flowchart illustrating a process of setting the rotational speed of a conveyance motor.

As illustrated in FIG. 6, when it is determined that the belt unit 50 is attached to the apparatus main body 10 (Yes in S101), the controller 100 reads the third sheet conveying speed VCs of the registration roller 26 and the reference sheet conveying speed VBr of the transfer belt 53 from the second memory 200 (S202) (reading process).

When it is determined, in step S106, that the fifth speed difference VBD is within the range of the determination threshold (Yes in S106), the controller 100 calculates the second speed difference VD2 from the first sheet conveying speed VBs and the third sheet conveying speed VCs (S207), and proceeds to step S210.

When it is determined, in step S104, that the first sheet conveying speed VBs cannot be read (No in S104) and when it is determined, in step S106, that the fifth speed difference VBD is not within the determination threshold range (No in S106), the controller 100 calculates the fourth speed difference VD4 from the reference sheet conveying speed VBr and the third sheet conveying speed VCs (S208). Then, the controller 100 sets the fourth speed difference VD4 as the second speed difference VD2 (S209)

In step S210, the controller 100 sets the rotational speed N1 of the conveyance motor M1 from the second speed difference VD2 and the second reference value VA2 (S210) (motor control process). Then, the controller 100 stores the set rotational speed N1 as the rotational speed of the conveyance motor M1 (S211), and ends the process of setting the rotational speed of the conveyance motor M1.

According to the embodiment described as above, since the fixing motor M3 can be controlled by setting the rotational speed N3 of the fixing motor M3 from the first sheet conveying speed VBs stored in the first memory 300 of the replaceable belt unit 50, the speed difference between the actual sheet conveying speed of the transfer belt 53 and the actual sheet conveying speed of the fixing unit 70 can be kept within a fixed range. With this configuration, it is possible to suppress excessive bending of the sheet S between the transfer belt 53 and the fixing unit 70 and slippage of the sheet S in the belt unit 50 or the fixing unit 70.

Since the belt motor M2 drives not only the transfer belt 53 but also the photosensitive drum 41, the number of motors provided in the image forming apparatus 1 can be reduced.

When the cover 11 is closed and the belt unit 50 is attached to the apparatus main body 10, the reading process is started and thus, when the belt unit 50 is replaced with a new one and there is a high possibility that the speed difference between the actual sheet conveying speed of the transfer belt 53 and the actual sheet conveying speed of the fixing unit 70 changes, the rotational speed N3 of the fixing motor M3 and the rotational speed N1 of the conveying motor M1 can be set. With this configuration, it is possible to more reliably suppress excessive bending of the sheet S and slippage of the sheet S.

When the first sheet conveying speed VBs cannot be read from the first memory 300 or when the value of the first sheet conveying speed VBs read in the reading process is an abnormal value, since control is performed with the third speed difference VD3 as the first speed difference VD1, even in these cases, it is possible to keep the speed difference between the actual sheet conveying speed of the transfer belt 53 and the actual sheet conveying speed of the fixing unit 70 within a fixed range.

According to this embodiment, since the rotational speed N1 of the conveyance motor M1 can be set from the first sheet conveying speed VBs to control the conveyance motor M1, it is possible to keep the speed difference between the actual sheet conveying speed of the transfer belt 53 and the actual sheet conveying speed of the registration roller 26 within a fixed range. With this configuration, it is possible to more reliably suppress excessive bending of the sheet S between the registration roller 26 and the transfer belt 53 and slippage of the sheet on the registration roller 26 or the belt unit 50.

When the first sheet conveying speed VBs cannot be read from the first memory 300 or when the value of the first sheet conveying speed VBs read in the reading process is an abnormal value, since control is performed with the fourth speed difference VD4 as the second speed difference VD2, even in these cases, it is possible to keep the speed difference between the actual sheet conveying speed of the transfer belt 53 and the actual sheet conveying speed of the registration roller 26 within a fixed range.

Although one embodiment of the disclosure is described above, the present invention is not limited to the embodiment described above, and can be appropriately modified and implemented.

For example, the controller 100 or the second memory 200 stores a first abrasion prediction value and a second abrasion prediction value. The first abrasion prediction value is a deceleration value of the sheet conveying speed of the fixing unit 70 which is predicted when the pressure roller 72 of the fixing unit 70 or the like is abraded by the transport of the sheet S. The second abrasion prediction value is a deceleration value of the sheet conveying speed of the registration roller 26 which is predicted when the registration roller 26 is abraded by the transport of the sheet S.

When the second sensor 6 or the like detects that the belt unit 50 has been replaced with a new one, the controller 100 determines whether or not the number of printed sheets S after the fixing unit 70 has been replaced by a serviceman is a predetermined number or more. When the controller 100 determines that the number of printed sheets since the fixing unit 70 has been replaced is the predetermined number or more, the controller 100 subtracts the first abrasion prediction value from the second sheet conveying speed VFs. Thereafter, the controller 100 controls the speed difference between the actual sheet conveying speed of the transfer belt 53 and the actual sheet conveying speed of the fixing unit 70 to approach the first reference value VA1.

As a result, even when the fixing unit 70 is abraded by the transport of the sheet S and the sheet conveying speed of the fixing unit 70 is reduced, it is possible to keep the speed difference between the actual sheet conveying speed of the transfer belt 53 and the actual sheet conveying speed of the fixing unit 70 within a fixed range. When the second sensor 6 or the like detects that the belt unit 50 has been replaced with a new one, the controller 100 determines whether or not the number of printed sheets S since the registration roller 26 has been replaced is a predetermined number or more by the serviceman. When the controller 100 determines that the number of printed sheets S after the registration roller 26 is replaced is the predetermined number or more, the controller 100 subtracts the second abrasion prediction value from the third sheet conveying speed VCs. Thereafter, the controller 100 controls the speed difference between the actual sheet conveying speed of the transfer belt 53 and the actual sheet conveying speed of the registration roller 26 to approach the second reference value VA2.

As a result, even when the registration roller 26 is abraded by the transport of the sheet S and the sheet conveying speed of the registration roller 26 is reduced, it is possible to keep the speed difference between the actual sheet conveying speed of the transfer belt 53 and the actual sheet transport of the registration roller 26 within a fixed range.

In the embodiment described above, although the belt motor M2 is configured to drive the photosensitive drum 41 together with the transfer belt 53, the photosensitive drum may be configured to be driven by a motor other than the belt motor.

In the embodiment described above, although the controller 100 is configured to start the reading process when the cover 11 is closed and the belt unit 50 is attached to the apparatus main body 10, but is not limited thereto. For example, the controller may be configured to start the reading process for each predetermined control cycle and set the transport speed of the motor in a state where an instruction to drive the motor is not received. That is, the timing for starting the reading process and setting the motor transport speed is arbitrary.

In the embodiment described above, when the first sheet conveying speed VBs cannot be read from the first memory 300, or the value of the first sheet conveying speed VBs read in the reading process is an abnormal value, the controller 100 is configured to set the rotational speed N3 of the fixing motor M3 with the third speed difference VD3 as the first speed difference VD1, but is not limited thereto. For example, in the case described above, the controller may be configured to set the rotational speed of the fixing motor to a default value. In the case described above, the controller may be configured to output an error message or the like without setting the rotational speed of the fixing motor. The same applies to setting of the rotational speed of the conveyance motor.

In the embodiment described above, the rotational speed N3 of the fixing motor M3 is set from the first speed difference VD1 and the first reference value VA1 in the motor control process, but is not limited thereto, and the rotational speed N2 of the belt motor M2 may be set. Both the rotational speed N2 of the belt motor M2 and the rotational speed N3 of the fixing motor M3 may be set. The first reference value may not be a single value but may be a value having a certain range.

In the embodiment described above, the rotational speed N1 of the conveyance motor M1 is set from the second speed difference VD2 and the second reference value VA2 in the motor control process, but is not limited thereto, and the rotational speed N2 of the belt motor M2 may be set. Both the rotational speed N2 of the belt motor M2 and the rotational speed N1 of the conveyance motor M1 may be set. The second reference value may not be a single value but may be a value having a certain range.

In the embodiment described above, the fixing unit 70 which includes the cylindrical fixing roller 71 made of metal as a fixing unit was illustrated, but is not limited thereto. For example, the fixing unit may be a fixing unit of a belt fixing type including a flexible endless fixing belt. The second sheet conveying speed stored in the second memory may be a calculation value calculated based on the value of the outer diameter of the pressure roller measured in advance.

In the embodiment described above, the registration roller 26 was illustrated as a conveyance roller, but is not limited thereto. For example, the pickup roller 22, the separation roller 23, the paper dust removing roller 25 and the like in the embodiment described above may be controlled in the same manner as the registration roller 26.

In the embodiment described above, the transfer belt 53 (conveyance belt) which conveys the sheet S between the transfer belt 53 and the photosensitive drums 41 is exemplified as a transfer belt, but is not limited thereto. For example, the transfer belt may be an intermediate transfer belt or the like by which a toner image is transferred from a photosensitive drum and the transferred toner image is transferred to a sheet.

In the embodiment described above, the present invention is applied to both the control of the speed difference between the sheet conveying speed of the transfer belt 53 and the sheet conveying speed of the fixing unit 70 and the control of the speed difference between the sheet conveying speed of the transfer belt 53 and the sheet conveying speed of the registration roller 26, but is not limited thereto. For example, the present disclosure may be applied only to the control of the speed difference between the sheet conveying speed of the transfer belt and the sheet conveying speed of the fixing unit. The present invention may be applied only to the control of the speed difference between the sheet conveying speed of the transfer belt and the sheet conveying speed of the registration roller.

In the embodiment described above, the image forming apparatus 1 for color printing provided with a plurality of the photosensitive drums 41 is illustrated as an image forming apparatus, but is not limited thereto. For example, the image forming apparatus may be an image forming apparatus for monochrome printing having only one photosensitive drum. The image forming apparatus may be a printer, or may be a multifunction machine, a copier, or the like provided with a document reading device such as a flatbed scanner.

In the embodiment described above, the sheet conveying speed based on the value measured in advance is stored in the first memory or the second memory, but is not limited thereto. For example, a configuration in which the thickness of the transfer belt, the value of the outer diameter of the belt drive roller, or the like are stored in the first memory and the sheet conveying speed of the transfer belt is calculated in the controller of the image forming apparatus may be adopted. The same applies to information stored in the second memory.

Respective elements described in the embodiment and modification examples described above can be implemented in appropriate combinations.

As described with reference to the embodiments, according to the image forming apparatus, it is possible to prevent excessive bending of the sheet and slippage of the sheet.

What is claimed is:

1. An image forming apparatus comprising:

an apparatus main body;

a photosensitive drum;

a belt unit that is detachably attachable to the apparatus main body, the belt unit including a transfer belt and a first memory, the transfer belt being configured to convey the sheet and to transfer a toner image on the photosensitive drum onto the sheet, the first memory storing a first sheet conveying speed which is an original sheet conveying speed of the transfer belt;

a fixing unit that includes a fixing roller that heats the sheet and a pressure roller that presses the fixing roller, the fixing unit configured to fix the toner image on the sheet conveyed by the transfer belt to the sheet in a state where the belt unit is attached to the apparatus main body;

a belt motor configured to drive the transfer belt;

a fixing motor configured to drive the fixing unit;

a second memory storing a second sheet conveying speed and a first reference value, wherein the second sheet conveying speed is an original sheet conveying speed of the fixing unit, and wherein the first reference value is a reference value of a speed difference between an actual sheet conveying speed of the transfer belt and an actual sheet conveying speed of the fixing unit; and a controller configured to:

read the first sheet conveying speed from the first memory;

read the second sheet conveying speed from the second memory; and control at least one of the belt motor and the fixing motor to bring the speed difference between the actual sheet conveying speed of the transfer belt and the actual sheet conveying speed of the fixing unit closer to the first reference value by setting at least one of a rotational speed of the belt motor and a rotational speed of the fixing motor based on the first reference value and a first speed difference which is a speed difference between the first sheet conveying speed read from the first memory and the second sheet conveying speed read from the second memory.

2. The image forming apparatus according to claim 1, wherein the first sheet conveying speed, which is stored in the first memory, is the original sheet conveying speed of the transfer belt that is obtained based on a value measured in advance.

3. The image forming apparatus according to claim 1, wherein the second sheet conveying speed, which is stored in the second memory, is the original sheet conveying speed of the fixing unit that is obtained based on a value measured in advance.

4. The image forming apparatus according to claim 1, wherein the belt motor is configured to drive the photosensitive drum.

5. The image forming apparatus according to claim 1, wherein, in controlling at least one of the belt motor and the fixing motor, the controller sets the rotational speed of the fixing motor based on the first speed difference and the first reference value.

6. The image forming apparatus according to claim 5, wherein, in controlling at least one of the belt motor and the fixing motor, the controller decreases the rotational speed of the fixing motor in a case where the first speed difference is greater than the first reference value and increases the rotational speed of the fixing motor in a case where the first speed difference is smaller than the first reference value.

7. The image forming apparatus according to claim 1, wherein the transfer belt conveys the sheet between the transfer belt and the photosensitive drum.

8. The image forming apparatus according to claim 1, wherein the transfer belt is an endless belt.

9. The image forming apparatus according to claim 1, wherein the first sheet conveying speed is an actual measurement value of the original sheet conveying speed of the transfer belt measured in advance.

10. The image forming apparatus according to claim 1, wherein the belt unit includes a belt drive roller and a belt driven roller, wherein the belt drive roller is configured to drive the transfer belt and is in contact with an inner circumferential surface of the transfer belt, wherein the belt driven roller is configured to be rotated by being driven by the transfer belt and is positioned at a position apart from the belt drive roller, and wherein the belt driven roller is in contact with the inner circumferential surface of the transfer belt, and wherein the first sheet conveying speed is a calculation value calculated based on a thickness of the transfer belt measured in advance and a value of an outer diameter of the belt drive roller.

11. The image forming apparatus according to claim 1, wherein the first sheet conveying speed stored in the first memory is faster than the second sheet conveying speed stored in the second memory.

12. The image forming apparatus according to claim 1, wherein the second sheet conveying speed is an actual measurement value of the original sheet conveying speed of the fixing unit measured in advance.

13. The image forming apparatus according to claim 1, wherein the fixing unit includes a fixing roller that is configured to heat the sheet, and wherein the second sheet conveying speed is a calculation value calculated based on a value of an outer diameter of the fixing roller measured in advance.

14. The image forming apparatus according to claim 1, wherein the apparatus main body includes a cover that is configured to take an opened state and a closed state, wherein the cover allows the belt unit to be attached to and detached from the apparatus main body in the opened state, wherein the image forming apparatus further comprises:

a first sensor configured to detect the opened state and the closed state of the cover; and a second sensor that detects whether or not the belt unit is attached to the apparatus main body, wherein the controller starts reading the first sheet conveying speed and the second sheet conveying speed in a state where the first sensor detects the cover being at the closed state and the second sensor detects the belt unit being attached to the apparatus main body.

15. The image forming apparatus according to claim 1, wherein the second memory is configured to store a reference sheet conveying speed which is a reference value of the sheet conveying speed of the transfer belt, and wherein the controller is configured to:

in reading the first sheet conveying speed and the second sheet conveying speed, read the reference sheet conveying speed from the second memory in a case where the first sheet conveying speed is not able to be read out from the first memory; and in controlling at least one of the belt motor and the fixing motor, set a speed difference between the reference sheet conveying speed read from the second memory and the second sheet conveying speed read from the second memory as the first speed difference.

16. The image forming apparatus according to claim 1, wherein the second memory is configured to store a reference sheet conveying speed which is a reference value of the actual sheet conveying speed of the transfer belt, and wherein the controller is configured to:

in reading the first sheet conveying speed and the second sheet conveying speed, read the reference sheet conveying speed from the second memory; and in controlling at least one of the belt motor and the fixing motor, set a speed difference between the reference sheet conveying speed read from the second memory and the second sheet conveying speed read from the second memory as the first speed difference in a case where the speed difference between the first sheet conveying speed read from the first memory and the reference sheet conveying speed read from the second memory is out of a range of a determination threshold.

17. An image forming apparatus comprising:

an apparatus main body;

a photosensitive drum;

a belt unit that is detachably attachable to the apparatus main body, the belt unit including a transfer belt and a first memory, the transfer belt being configured to convey the sheet and to transfer a toner image on the photosensitive drum onto the sheet, the first memory storing a first sheet conveying speed which is an original sheet conveying speed of the transfer belt;

a conveyance roller configured to convey the sheet toward the transfer belt in a state where the belt unit is attached to the apparatus main body;

a belt motor configured to drive the transfer belt;

a conveyance motor configured to drive the conveyance roller;

a second memory storing a third sheet conveying speed and a second reference value, wherein the third sheet conveying speed is an original sheet conveying speed of the conveyance roller, and wherein the second reference value is a reference value of a speed difference between an actual sheet conveying speed of the transfer belt and an actual sheet conveying speed of the conveyance roller; and a controller configured to:

read the first sheet conveying speed from the first memory;

read the third sheet conveying speed from the second memory; and control at least one of the belt motor and the conveyance motor to bring the speed difference between the actual sheet conveying speed of the transfer belt and the actual sheet conveying speed of the conveyance roller closer to the second reference value by setting at least one of a rotational speed of the belt motor and a rotational speed of the conveyance motor based on the second reference value and a second speed difference which is a speed difference between the first sheet conveying speed read from the first memory and the third sheet conveying speed read from the second memory.

18. The image forming apparatus according to claim 17, wherein the first sheet conveying speed, which is stored in the first memory, is the original sheet conveying speed of the transfer belt that is obtained based on a value measured in advance.

19. The image forming apparatus according to claim 17, wherein the third sheet conveying speed, which is stored in the second memory, is the original sheet conveying speed of the conveyance roller that is obtained based on a value measured in advance.

20. The image forming apparatus according to claim 17, wherein, in controlling at least one of the belt motor and the conveyance motor, the controller sets the rotational speed of the conveyance motor based on the second speed difference and the second reference value.

21. The image forming apparatus according to claim 20, wherein, in controlling at least one of the belt motor and the conveyance motor, the controller reduces the rotational speed of the conveyance motor in a case where the second speed difference is greater than the second reference value and increases the rotational speed of the conveyance motor in a case where the second speed difference is smaller than the second reference value.

22. The image forming apparatus according to claim 17, wherein the first sheet conveying speed stored in the first memory is slower than the third sheet conveying speed stored in the second memory.

23. The image forming apparatus according to claim 17, wherein the third sheet conveying speed is an actual measurement value of the original sheet conveying speed of the conveyance roller measured in advance.

24. The image forming apparatus according to claim 17, wherein the conveyance roller includes a conveyance driving roller to which a driving force is applied from the conveyance motor and a conveyance driven roller which is rotated by being driven by the conveyance driving roller, and wherein the third sheet conveying speed is a calculation value calculated based on a value of an outer diameter of the conveyance driving roller measured in advance.

25. The image forming apparatus according to claim 17, wherein the second memory is configured to store a reference sheet conveying speed which is a reference value of the actual sheet conveying speed of the transfer belt, and wherein the controller is configured to:

in reading the first sheet conveying speed and the third sheet conveying speed, read the reference sheet conveying speed from the second memory in a case where the first sheet conveying speed is not able to be read out from the first memory, and in controlling the belt motor and the conveyance motor, set a speed difference between the reference sheet conveying speed read from the second memory and the third sheet conveying speed read from the second memory as the second speed difference.

26. The image forming apparatus according to claim 17, wherein the second memory is configured to store a reference sheet conveying speed which is a reference value of the actual sheet conveying speed of the transfer belt, and wherein the controller is configured to:

in reading the first sheet conveying speed and the third sheet conveying speed, read the reference sheet conveying speed from the second memory, and in controlling at least one of the belt motor and the conveyance motor, set a speed difference between the reference sheet conveying speed read from the second memory and the third sheet conveying speed read from the second memory as the second speed difference in a case where the speed difference between the first sheet conveying speed read from the first memory and the reference sheet conveying speed read from the second memory is out of a range of a determination threshold.

* * * * *